US011289817B2

(12) United States Patent
Somerlock, III et al.

(10) Patent No.: US 11,289,817 B2
(45) Date of Patent: Mar. 29, 2022

(54) RECONFIGURABLE REFLECTARRY FOR PASSIVE COMMUNICATIONS

(71) Applicant: The Johns Hopkins University, Baltimore, MD (US)

(72) Inventors: Oscar F. Somerlock, III, Potomac, MD (US); Robert L. Schmid, Columbia, MD (US); David B. Shrekenhamer, Bethesda, MD (US); Amanda C. Malone, Laurel, MD (US); Timothy A. Sleasman, Takoma Park, MD (US); Ra'id S. Awadallah, Baltimore, MD (US)

(73) Assignee: The Johns Hopkins University, Baltimore, MD (US)

( * ) Notice: Subject to any disclaimer, the term of this patent is extended or adjusted under 35 U.S.C. 154(b) by 92 days.

(21) Appl. No.: 16/864,351

(22) Filed: May 1, 2020

(65) Prior Publication Data

US 2020/0350691 A1 Nov. 5, 2020

Related U.S. Application Data

(60) Provisional application No. 62/842,583, filed on May 3, 2019.

(51) Int. Cl.
*H01Q 15/00* (2006.01)

(52) U.S. Cl.
CPC ..... *H01Q 15/002* (2013.01); *H01Q 15/0033* (2013.01); *H01Q 15/0086* (2013.01)

(58) Field of Classification Search
CPC .... H01Q 3/46; H01Q 15/002; H01Q 15/0033; H01Q 15/0086
See application file for complete search history.

(56) References Cited

U.S. PATENT DOCUMENTS

| | | | | |
|---|---|---|---|---|
| 8,967,485 | B2 * | 3/2015 | Piazza | H01Q 3/00 235/492 |
| 2017/0069967 | A1 * | 3/2017 | Shrekenhamer | H01Q 1/28 |
| 2018/0138570 | A1 * | 5/2018 | Casse | H01Q 3/36 |
| 2018/0166781 | A1 * | 6/2018 | Snyder | H01Q 5/357 |

* cited by examiner

*Primary Examiner* — Daniel Munoz
(74) *Attorney, Agent, or Firm* — Noah J. Hayward

(57) ABSTRACT

A reconfigurable reflectarray antenna (RAA) system includes a reconfigurable RAA and a controller. The RAA includes a metasurface having a dynamically tunable electromagnetic characteristic and is configured to receive a signal of opportunity. The signal of opportunity is generated separately and independently from the reconfigurable RAA system. The controller is in signal communication with the reconfigurable RAA and is configured to generate a control signal configured to dynamically tune the electromagnetic characteristic of the metasurface. The electromagnetic characteristic includes a reflection phase, which when varied, dynamically beam steers the signal of opportunity reflected from the metasurface.

18 Claims, 9 Drawing Sheets

RECONFIGURABLE REFLECTARRY FOR PASSIVE COMMUNICATIONS

CROSS REFERENCE TO RELATED APPLICATIONS

This application claims priority to and the benefit of prior-filed, U.S. Provisional Application Ser. No. 62/842,583 filed on May 3, 2019, the entire content of which is incorporated herein by reference.

BACKGROUND

The disclosure relates generally to high-gain antennas, and more particularly, to a reflectarray antennas for passive communications.

Reflectarray antennas (RAA) provide a cost effective means to steer energy without the complexity of phased arrays. In typical data communication applications using an RAA, a transmitter is connected locally with the RAA to point a data signal to be transmitted toward a receiver. While RAAs are most commonly found to have a static radiation pattern, recent work has investigated reconfigurable RAA technology. Typically, the RAA implements a plurality of unit cells, and the states of the unit cells can be adjusted to facilitate multiple operational states at the unit cell level.

In reconfigurable RAAs, the state of a given unit cell is typically controlled using the bias setting of PIN diodes or varactors. In this manner, the analog voltage applied to the PIN diodes or varactors can be adjusted to alter the reflected phase of resonating elements. For instance, PIN diodes can be implemented and controlled to electrically connect and disconnect metallic parts in order to introduce variations in the geometry of the total radiating surface.

BRIEF DESCRIPTION

According to one or more non-limiting embodiments, a reconfigurable reflectarray antenna (RAA) system includes a reconfigurable RAA and a controller. The RAA includes a metasurface having at least one dynamically tunable electromagnetic characteristic and configured to receive at least one signal of opportunity. The signal of opportunity is generated separately and independently from the reconfigurable RAA system. The controller is in signal communication with the reconfigurable RAA and is configured to generate a control signal configured to dynamically tune the at least one electromagnetic characteristic of the metasurface. The at least one electromagnetic characteristic includes a reflection phase configured to dynamically beam steer the at least one signal of opportunity reflected from the metasurface.

According to one or more non-limiting embodiments, a method of communicating a signal is provided. The method includes receiving, via a metasurface included in a reconfigurable RAA, at least one signal of opportunity generated separately and independently from the reconfigurable RAA. The at least one signal of opportunity has at least one dynamically tunable electromagnetic characteristic. The method further comprises generating, via a controller in signal communication with the reconfigurable RAA, a control signal configured to dynamically tune the at least one electromagnetic characteristic of the metasurface. The method further comprises dynamically beam steering the at least one signal of opportunity reflected from the metasurface in response to dynamically tuning the at least one electromagnetic characteristic.

Additional features and advantages are realized through the techniques of the present disclosure. Other embodiments and aspects of the disclosure are described in detail herein. For a better understanding of the disclosure with the advantages and the features, refer to the description and to the drawings.

BRIEF DESCRIPTION OF THE DRAWINGS

The subject matter is particularly pointed out and distinctly claimed in the claims at the conclusion of the specification. The forgoing and other features, and advantages of the embodiments shown and described herein are apparent from the following detailed description taken in conjunction with the accompanying drawings in which:

DETAILED DESCRIPTION

Figure 1:
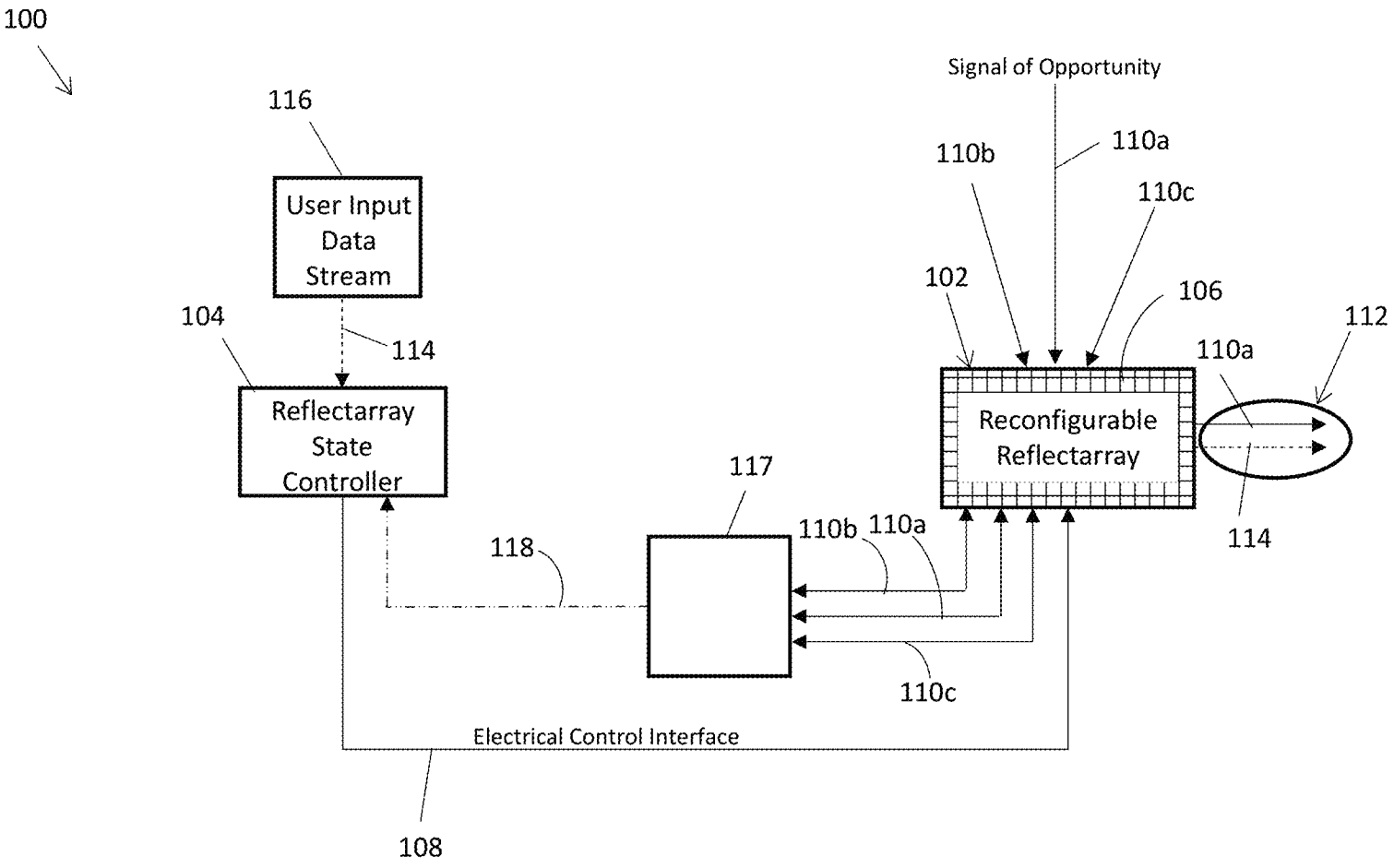
FIG. 1 is a block diagram illustrating a reconfigurable RAA system according to a non-limiting embodiment.

Transmitters typically installed locally in RAA systems require excessive power to broadcast data to one or more receivers. Also, as described above, conventional RAAs typically implement PIN diodes or varactors as a tunable components or control switches to vary the state of a given unit cell. However, the required local transmitter along with the conventional control switch limit the ability to reduce overall size, weight and power efficiency of a traditional RAA system.

Various non-limiting embodiments described herein provide a reconfigurable RAA system that includes an RAA capable of utilizing an energy signal that is generated separately and independently from the RAA system. More specifically, a reconfigurable RAA system according to one or more non-limiting embodiments is capable of utilizing an energy signal referred to herein as a "signal of opportunity", which is already present in the vicinity of the reconfigurable RAA rather than being actively generated by a local transmitter connected to the RAA. The signal of opportunity can be generated, for example, by radio towers located in the vicinity of the RAA and/or by locally operated unmanned vehicles or drones. The reconfigurable RAA system can therefore communicate data by reflecting a signal of opportunity towards a receiver and dynamically change the reflection properties in real time to control the delivery of the signal of opportunity rather than requiring an additional transmitter to generate and control a signal to be delivered to the receiver.

The reconfigurable RAA described herein employs a metamaterial surface referred to herein as a "metasurface," which includes a reconfigurable array of unit cells controlled by tunable components. In one or more embodiments, the tunable components include gallium arsenide (GaAs) field effect transistors (FETS). The GaAs FETs can operate at high switching speeds to effect fast reflection phase changes of the metasurface between 0 degrees and 180 degrees. The embodiments described herein also allows for implementing different types of FETs having more than two switching positions or that implement other digital/analog components as the tunable components to provide higher-order modulations beyond binary phase shift keying (BPSK), such as quadrature phase shift keying (QPSK) modulation or even higher-order phase shift keying modulation schemes such as 8-PSK, for example. In these embodiments, the reflection phase change of the metasurface can be continuously varied between 0 degrees and 360 degrees. In any case, the switching frequency of the FET can dynamically change the reflection phase of the metasurface to beam steer a signal of opportunity in a desired direction and/or modulate data onto the signal of opportunity to facilitate wireless communication of a signal. Unlike conventional reconfigurable RAAs known to implement PIN diodes or varactors, GaAs FETs operate using significantly lower power requirements and without the additional circuitry used to operate the PIN diodes or varactors. Accordingly, a reconfigurable RAA system according to various non-limiting embodiments described herein can be provided to achieve reduced size, weight and power requirements compared to conventional RAA systems.

Turning now to FIG. 1, a reconfigurable RAA system 100 is depicted according to one or more non-limiting embodiments. The reconfigurable RAA system 100 includes a reconfigurable RAA 102 in signal communication with a controller 104. In one or more non-limiting embodiments, a user input data device 116 can be used to input user-defined data 114 to the controller 104. The input data device 116 can include a computing device including, but not limited to, a laptop computer, a tablet computer, a smart phone, a microcontroller, a sensor, and a smart wearable device. The input data device 116 can input media data such as an image or audio input. This user-defined data is a low-power data signal 114, which can be modulated using one or more signals of opportunity 110*a*, 110*b*, 110*c*, and steered (i.e., directed) toward a targeted receiver (not shown in FIG. 1) as described in greater detail below.

The reconfigurable RAA 102 includes a metasurface 106 configured to receive and reflect one or more signals of opportunity 110*a*, 110*b*, 110*c*, etc. A signal of opportunity 110*a*, 110*b*, 110*c*, etc. is generated separately and independently from the reconfigurable RAA system 100. That is, one or more signals of opportunity 110*a*, 110*b*, 110*c* received by the reconfigurable RAA 102 are generated by external signal sources including, but not limited to, radio towers and/or by locally operated unmanned vehicles rather than generated by a transmitter installed locally or included with the reconfigurable RAA system 100. A signal of opportunity 110*a*, 110*b*, 110*c*, etc., can be generated as a radio frequency (RF) signal, for example, and may or may not include pre-existing additional data modulated thereon.

The metasurface 106 has at least one dynamically tunable electromagnetic characteristic. The electromagnetic characteristic includes, but is not limited to, a reflection phase of the metasurface 106. Accordingly, varying the reflection phase can maintain the signal reflection (e.g., maintain high reflection with minimal losses) of the metasurface 106, but can change the reflection phase of an incident electromagnetic wave (e.g., a signal of opportunity 110*a*, 110*b*, 110*c*) at a given wavelength. In other words, the reflection phase of a signal of opportunity 110*a*, 110*b*, 110*c* impinging on the metasurface 106 can be changed dynamically. In one instance, an incident signal of opportunity (e.g., signal 110*a*) can be reflected at a first reflection phase (e.g., pi ($\pi$)) and can by dynamically changed in real time to reflect at a second reflection phase (e.g., 0) in response to changing the electromagnetic properties of the metasurface 106.

The controller 104 includes memory and a processor configured to execute algorithms and computer-readable program instructions stored in the memory. Accordingly, the controller 104 is capable of generating a control signal 108 configured to dynamically tune an electromagnetic characteristic (e.g., the reflection phase) of the metasurface 106. In this manner, the controller 104 can dynamically reconfigure the metasurface 106 such that the reconfigurable RAA 102 can dynamically beam steer and/or modulate one or more signals of opportunity 110*a*, 110*b*, 110*c* impinging on the metasurface 106. The beam steering includes, for example, changing the direction at which the main lobe of the signal of opportunity 110 is reflected from the metasurface 106.

As mentioned above, once the controller 104 determines a targeted direction at which to steer the signal of opportunity (e.g., 110*a*), the controller 104 can also modulate the reflected signal of opportunity 110*a* based on an input data signal 114. In one or more non-limiting embodiments, the controller 104 can continuously vary the reflective phase according to a data rate indicated by the input data signal 114. For example, the reflective phase can be varied between 0°-180°, or between 0°-360°. In one or more non-limiting embodiments, the phase change can be effected at very high frequencies such as, for example, about 1 megahertz (MHz) or even greater. Accordingly, the controller 104 can receive an input data signal 114 from the input user device 116 and output a control signal 108 that continuously varies the reflective phase of the metasurface 106 based on the input data stream 114. In this manner, a modulated data signal 112 comprising the reflected signal of opportunity 110*a* and the input data stream 114 can be directed to one or more targeted receivers (not shown in FIG. 1).

In one or more non-limiting embodiments, the reconfigurable RAA system 100 includes a signal detection system 117 in signal communication with the reconfigurable RAA 102. In some embodiments, the signal detection system 117 can be separate from the reconfigurable RAA system 100, while in other embodiments the signal detection system 117 can be integrated (e.g., installed locally) with the reconfigurable RAA system 100. The signal detection system 117 is configured to detect one or more signals of opportunity 110*a*, 110*b*, 110*c* that impinge the metasurface 106. In response to detecting the signals of opportunity 110*a*, 110*b*, 110*c*, the signal detection system 117 generates signal information 118 respective to each signal, which is delivered to the controller 104. The signal information 118 includes, but is not limited to, angle of arrival, frequency, and power. In this manner when the reconfigurable RAA 102 can receive several different signals of opportunity 110*a*, 110*b*, 110*c*, and the controller 104 can identify one or more targeted signals of opportunity (e.g., signal 110*a*) to be beam steered and/or modulated based on the signal information 118 while disregarding one or more of the non-targeted signals of opportunity (e.g., signals 110*b* and 110*c*).

Figure 2:
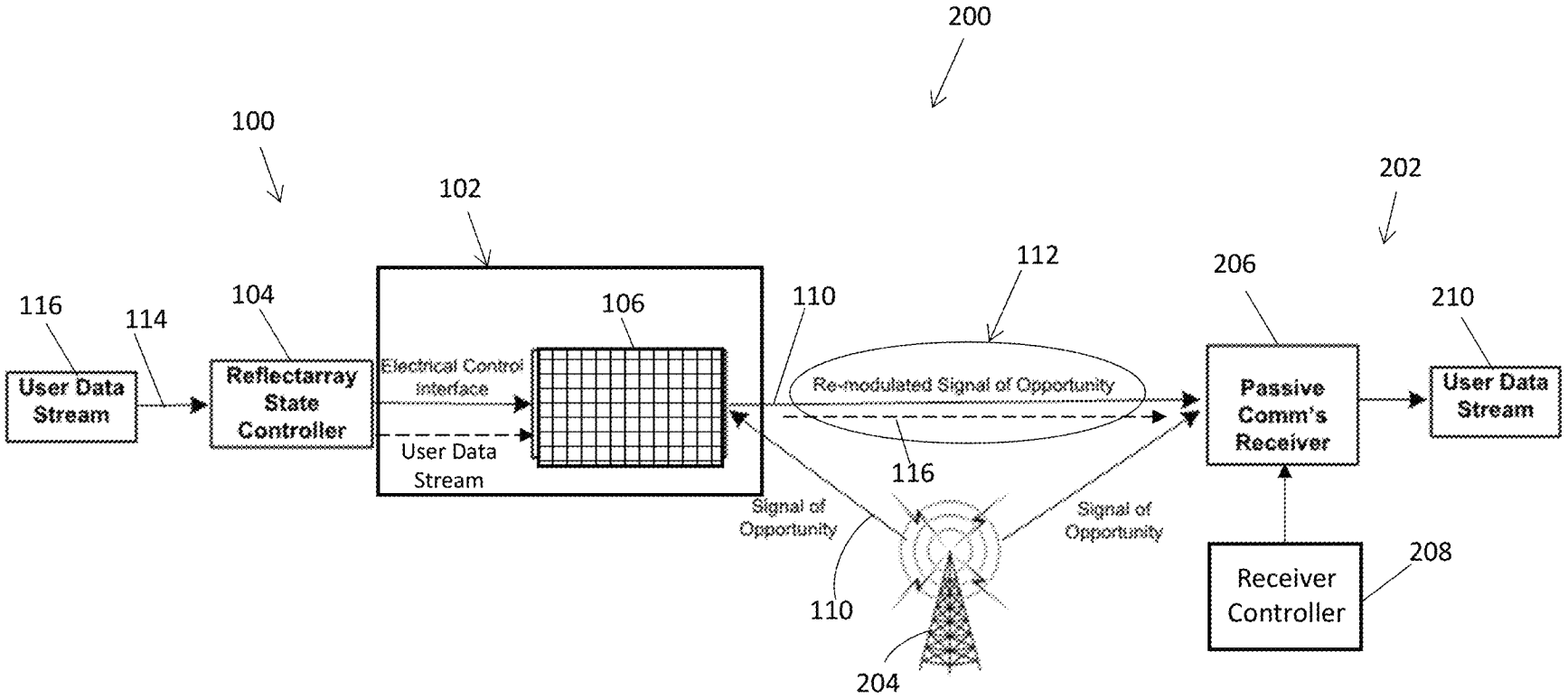
FIG. 2 is a block diagram illustrating an RAA communication system including a reconfigurable RAA according to a non-limiting embodiment.

Referring to FIG. 2, the reconfigurable RAA system 100 can be operated along with a corresponding receiver system 202 to establish a reflectarray antenna (RAA) communication system 200. Various receiver systems can be used in conjunction with the reconfigurable RAA 102 without departing from the scope of the invention. As an example, the receiver system 202 includes a receiver 206 and a receiver controller 208. The receiver 206 is in wireless signal communication with the reconfigurable RAA 102 and is configured to receive a beam steered signal 110 and/or a modulated data signal 112 (i.e., the beam steered signal 110 and data signal 114). The receiver controller 208 includes memory and a processor configured to execute algorithms and computer-readable program instructions stored in the memory. Accordingly, the receiver controller 208 is in signal communication with the receiver 206 and is configured to perform signal processing on the beam steered signal 110 and/or a modulated data signal 112. The signal processing includes, but is not limited to, demodulating the modulated data signal 112 to determine the input data signal 114. In this manner, the information contained in the beam steered signal 110 and/or the modulated signal 112 (e.g., the input user data 114) can be recovered. In one or more embodiments, the processed data generated by the receiver controller 208 can be output to one or more receiving user devices 210. The receiving user devices 210 include, but are not limited to, a workstation, a laptop computer, a tablet computer, a smart phone, and a smart wearable device. The receiving user device 210 can output media data such as an image and/or audio, for example, based on the one or both of the modulated data signal 112 and the beam steered signal 110.

Figure 3:
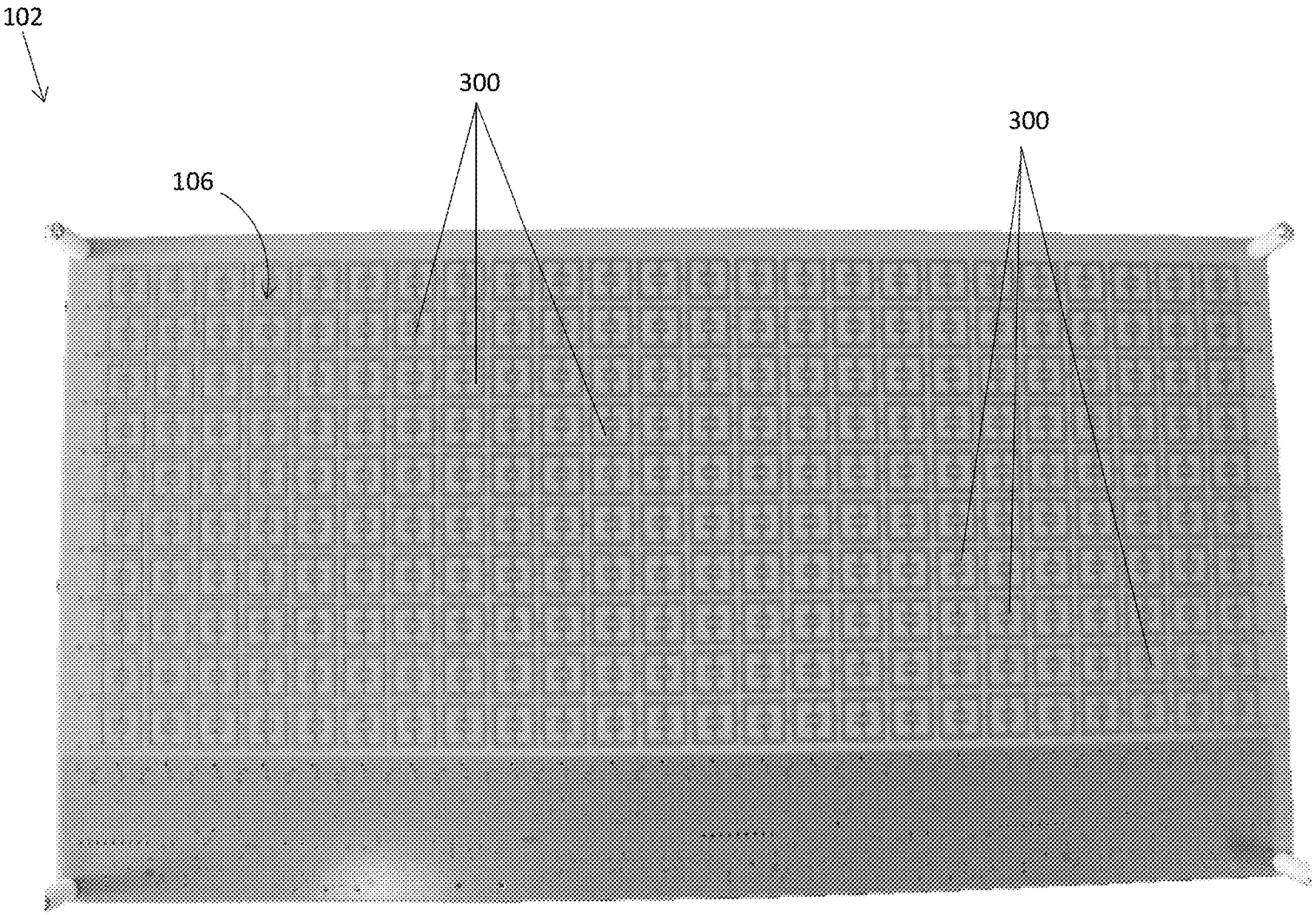
FIG. 3 depicts a metasurface of a reconfigurable RAA according to a non-limiting embodiment.
Figure 4:
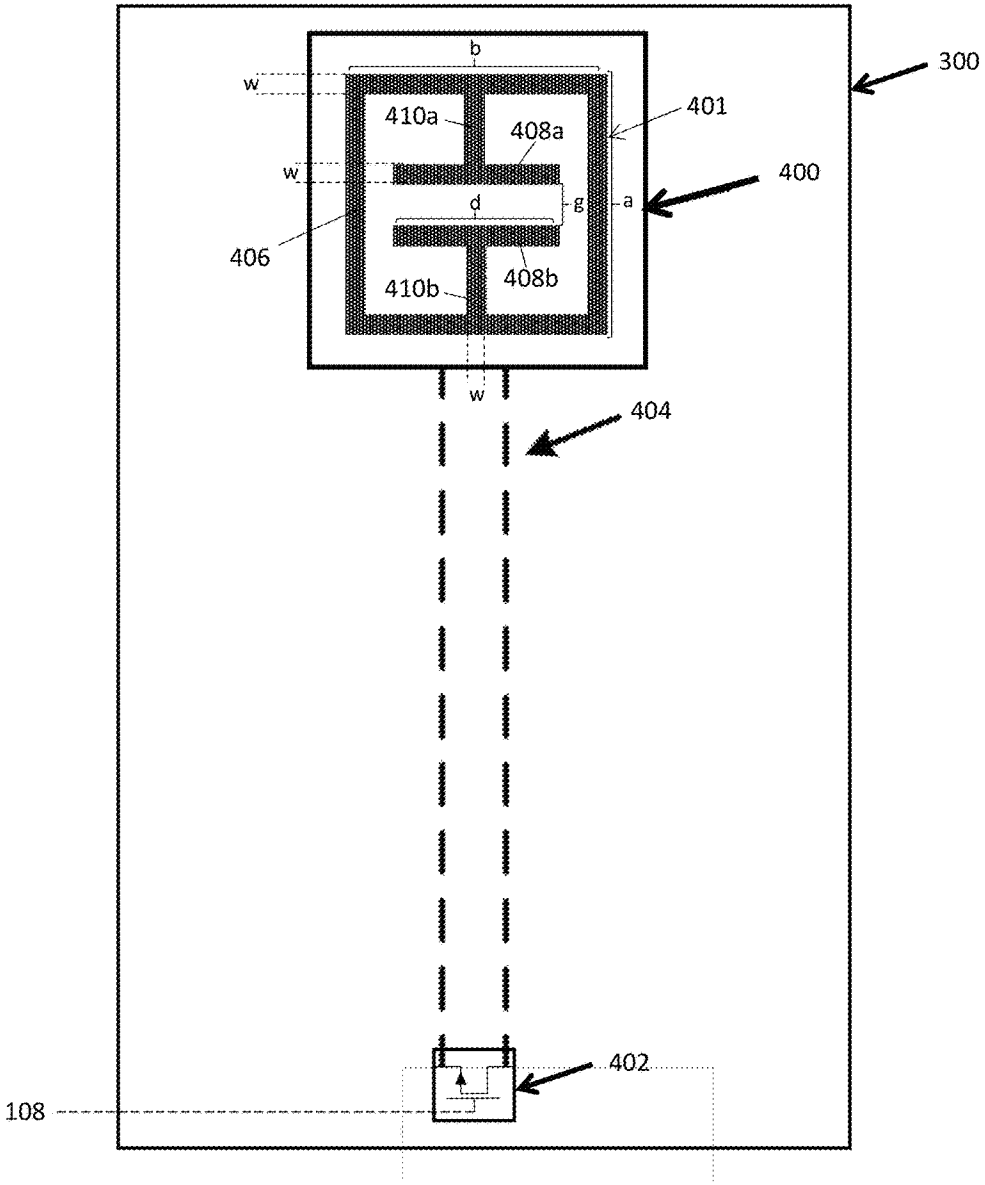
FIG. 4 is block diagram illustrating a unit cell included in a metasurface of a reconfigurable RAA according to a non-limiting embodiment.

FIGS. 3 and 4 describe the metasurface 106 and unit cells 300 in greater detail. Referring to FIG. 3, a metasurface 106 included in a reconfigurable RAA 102 is illustrated according to a non-limiting embodiment. The metasurface 106 includes a plurality of individual unit cells 300. In one or more non-limiting embodiments, the plurality of individual unit cells 300 define a repeating electrically conductive pattern that establishes a metasurface antenna array. The individual unit cells 300 can include an integrated tunable dielectric material (not shown in FIG. 3) that operates in conjunction with the electrically conductive pattern to effect an electrical resonance in response to being energized. Tuning the resonance of the unit cells 300 can therefore dynamically vary the electromagnetic characteristics of the metasurface 106 so as to facilitate beam steering of a signal of opportunity as described herein. The tuning of the electromagnetic characteristics may include changing the resonant frequency position, amplitude and/or phase of an impinging signal of opportunity.

As shown in FIG. 4, each unit cell 300 includes a resonant structure 400 in signal communication with a tunable component 402. Tunable component 402 can include, but is not limited to, a field effect transistor (FET), a PIN diode, a varactor, a microelectromechanical (MEM) system or device, and a liquid crystal polymer device. In one or more non-limiting embodiments, the FET includes a high-speed switching gallium arsenide (GaAs) FET 402, as described in greater detail below.

The resonant structure 400 is configured to selectively operate in a first state (e.g., an "on" state) and a second state (e.g., an "off" state) in response to a voltage signal 404 output from the tunable component 402. In one or more non-limiting embodiments, the resonant structure 400 includes a patterned metal layer 401 defining a split-type resonator having a common lead 406, a first split lead 408*a*, a first base portion 410*a*, a second split lead 408*b*, and a second base portion 410*b*. The common lead 406, first split lead 408*a*, first base portion 410*a*, second split lead 408*b*, and second base portion 410*b* comprise an electrically conductive material including, but not limited to, metal such as, for example, copper (Cu). The common lead 406 extends in a first direction (a) defining a first length and a second direction (b) defining a second length to form a closed loop.

The first base portion 410*a* includes a first end connected to the common lead 406 and an opposing second end connected to the first split lead 408*a*. The second base portion 410*b* includes a first end connected to the common lead 406 and an opposing second end connected to the second split lead 408*b*. The first split lead 408*a* and the second split lead 408*b* are arranged within the closed loop defined by the common lead 406 and are separated from one another by a distance (g). The first and second split leads 408*a* and 408*b* each extend between respective opposing ends to define a length (d).

Still referring to FIG. 4, the tunable component 402 is exemplified as a high-speed switching FET configured to generate the voltage signal 404 that actively varies the resonant behavior of the resonant structure 400. The high-speed FET 402 includes, for example, a GaAs FET 402, which is capable of switching between operating states (e.g., between an "on" state and an "off" state) on the order of approximately 100 nanoseconds (ns). The "on" state and "off" state effectively represents a "shorted" state and an "opened" state configuration, respectively. Accordingly, the FET 402 can achieve a parasitic capacitance and inductance in both states that are low relative to the geometric equivalent represented in the unit cell 300. In the "open" state, for example, the unit cell 300 behaves as if the FET 402 establishes a virtual open circuit, while in the "shorted" state the unit cell 300 behaves as if the FET 402 establishes a virtual short circuit or continuous electrical path through a virtual capacitive gap.

The FET 402 generates the voltage signal 404 in response to receiving a control signal 108 output from the controller 104 (not shown if FIG. 4). The control signal 108 can serve as a gate signal, e.g., a gate signal 108, for example, having a voltage controlled by the controller 104. Accordingly, the FET 402 generates the voltage signal 404 having a first voltage that invokes the first state of the resonant structure 400 (e.g., switches "on" the resonant structure 400) in response to receiving a gate signal 108 having a first voltage level (e.g. 5V) and generates the voltage signal 404 having a second voltage that invokes the second state of the resonant structure 400 (e.g., switches "off" the resonant structure) in response to receiving a gate signal 108 having a second voltage level (e.g., 0V).

Figure 5:
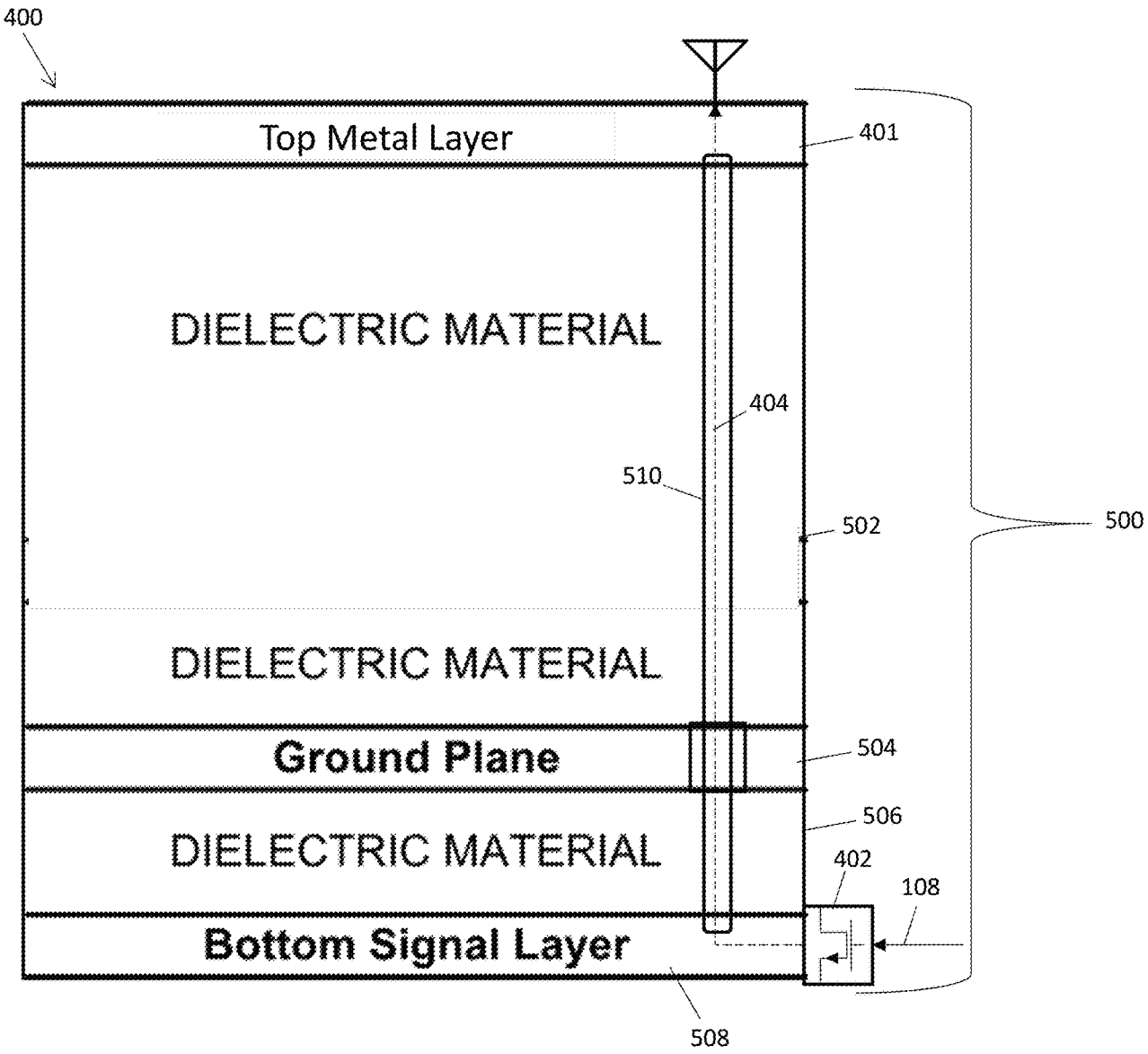
FIG. 5 is a block diagram illustrating a printed circuit board or integrated circuit of a unit cell included in a metasurface of a reconfigurable RAA according to a non-limiting embodiment.

Referring to FIG. 5, the resonant structure 400 can be fabricated as a multilayer printed circuit board (PCB) 500 according to one or more non-limiting embodiments. It should be appreciated that the PCB 500 illustrated in FIG. 5 is an example, and that other embodiments implementing a combination of metal layers and dielectric layers such as an integrated circuit (IC), for example, can be used without departing from the scope of the invention. The PCB 500 can include a patterned metal layer 401, a first dielectric layer 502, a ground plane layer 504, a second dielectric layer 506, and a signal layer 508. The patterned metal layer 401 can comprise a metal material such as copper (Cu), for example, and the first and second dielectric layers 502 and 506 can comprise a laminate or silicon dioxide composite material. The PCB 500 can further include an electrically conductive via 510 that extends through the intermediate layers 502, 504, 506 and 508 to establish electrical conductivity between the patterned metal layer 401 and the signal layer 508.

Figure 6:
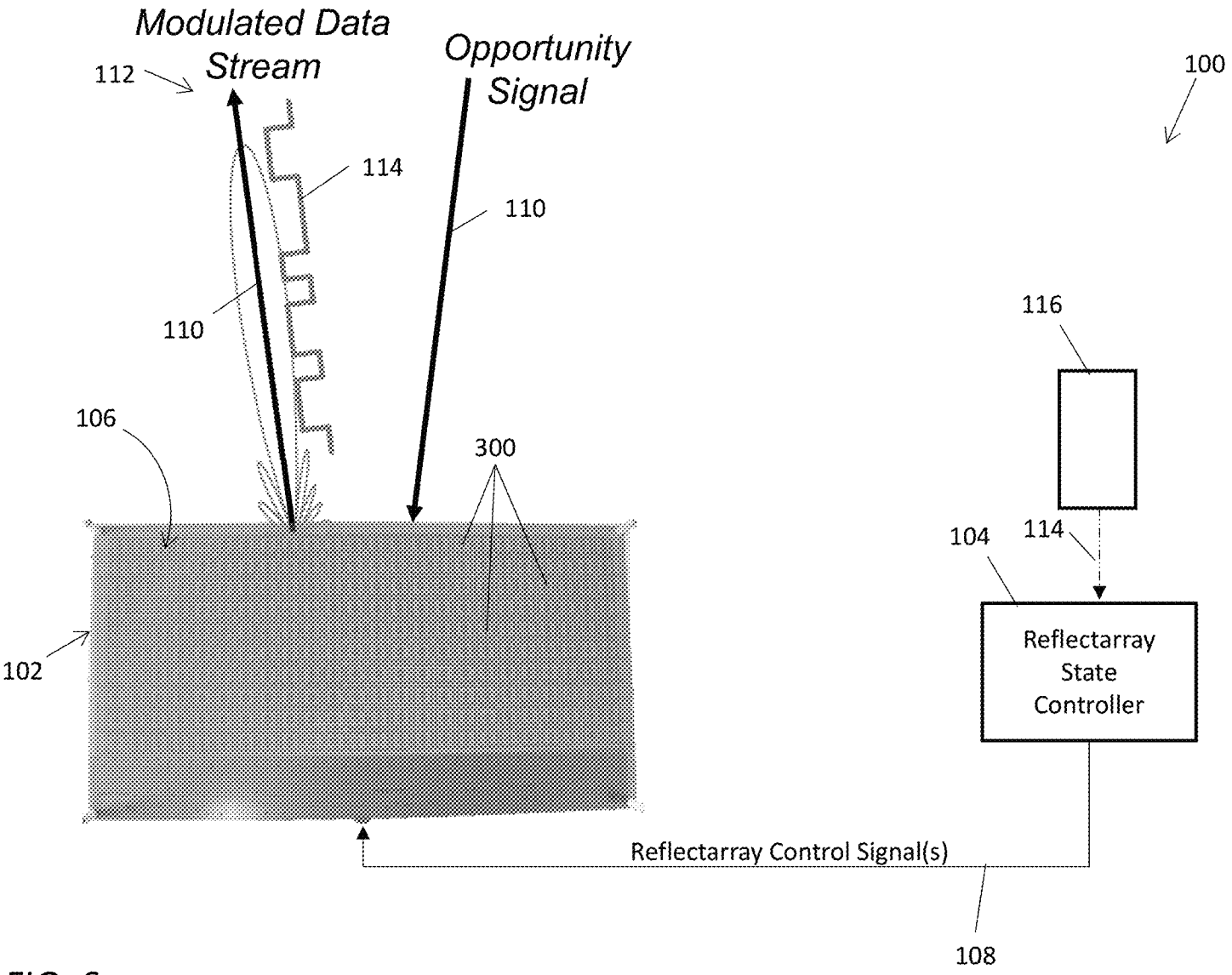
FIG. 6 depicts a reconfigurable RAA system operating in a first state to beam steer a modulated data signal in a first direction according to a non-limiting embodiment.
Figure 7:
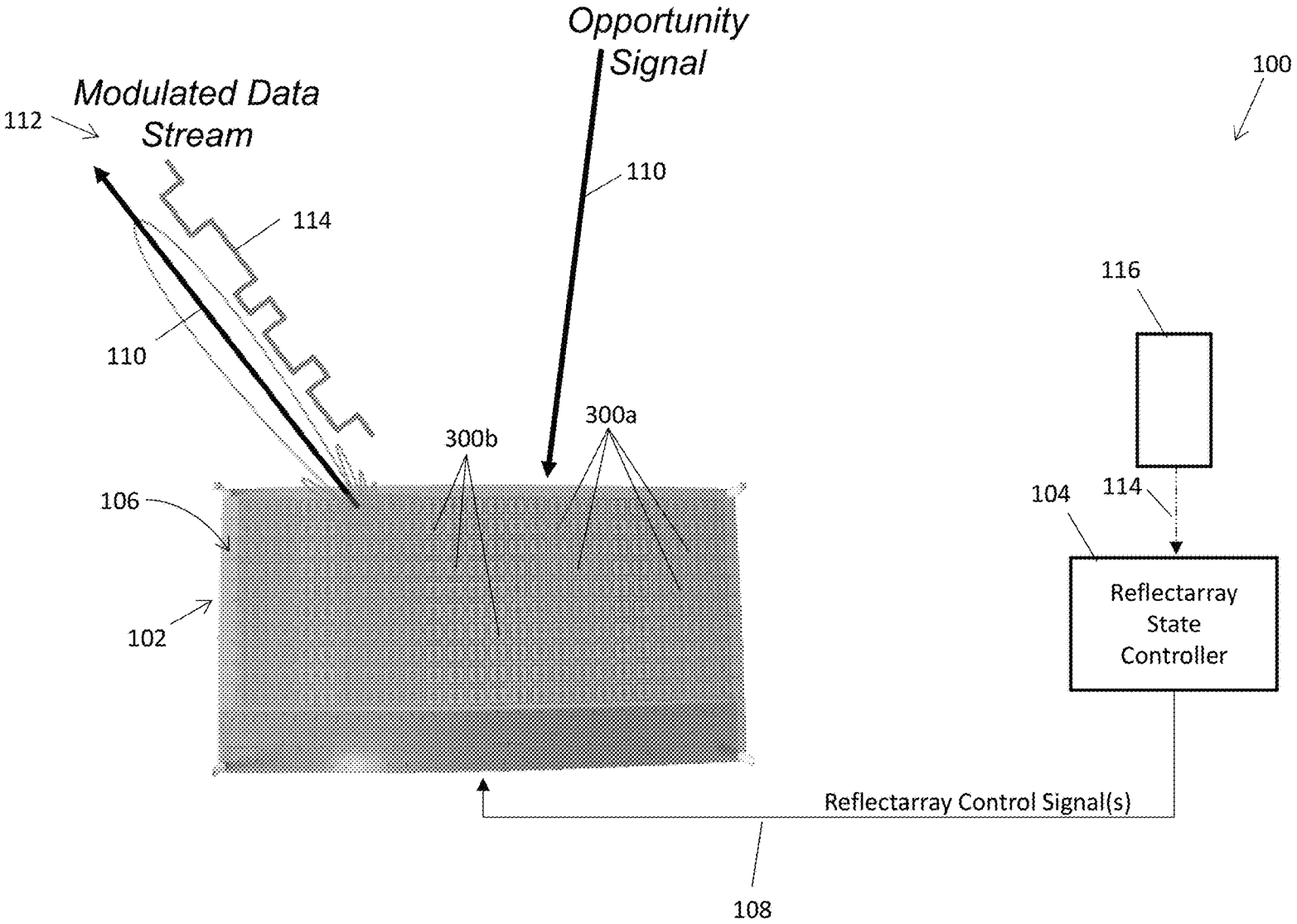
FIG. 7 depicts the reconfigurable RAA system of FIG. 6 operating in a second state to dynamically beam steer the modulated data signal in a second direction according to a non-limiting embodiment.

Turning now to FIGS. 6 and 7, a reconfigurable RAA system 100 operating in different states to beam steer a modulated data signal 112 is illustrated according to non-limiting embodiments. At FIG. 6, the reconfigurable RAA system 100 is illustrated operating in a first state to beam steer a modulated data signal 112 in a first direction. More specifically, a signal of opportunity 110 is shown impinging the metasurface 106 of a reconfigurable RAA 102. In addition, the controller 104 receives an input data signal 114 to be modulated with the signal of opportunity 110. It should be appreciated that the reconfigurable RAA system 100 can operate to beam steer the signal of opportunity 110 without also performing a signal modulation operation when it is unnecessary to also transmit an input data signal.

The controller 104 generates one or more control signals 108 that continuously switch "on" and "off" a group of unit cells 300 according to a switching frequency (e.g., 100 ns). In this example, the group of targeted unit cells 300 are all the unit cells 300 included in the metasurface 106; however, additional example embodiments of the invention are not limited thereto. The selected group of unit cells 300 to be continuously switched "on" and "off" defines a first reflection phase, which in turn controls the direction at which the modulated data signal 112 is steered. The frequency at which the targeted group of unit cells 300 is switched effectively modulates the input data signal 114 on the signal of opportunity 110 to generate the modulated data signal 112 that is ultimately reflected from the reconfigurable RAA 102.

Turning now to FIG. 7, the reconfigurable RAA system 100 is illustrated operating in a second state to beam steer the modulated data signal 112 in a second direction. In this instance, the controller 104 generates one or more control signals 108 that continuously switch "on" and "off" a first group of unit cells 300*a* differently from a second group of unit cells 300*b*. In the example shown in FIG. 7, all the unit cells in the first group 300*a* are switch "on" through the control signal 108, while all the unit cells of the second group 300*b* are switched "off" through the control signal 108. The grouping of the unit cells into the first group 300*a* and the second group 300*b* defines the beam steering direction of the reflected signal 112. In one implementation, a change in the input data signal 114 will invert the states of the unit cells such that the first group of unit cells 300*a* are turned "off" while the second group of unit cells 300*b* are now switched "on". Selecting a different grouping of unit cells to continuously switch "on" and "off" changes the reflection phase of the metasurface 106, thereby changing the direction at which to steer the modulated data signal 112. The tunable component (not shown in FIG. 7) of each of the unit cells in groups 300*a* and 300*b* may be changed individually by the control signal 108 in real time. In this manner, the reconfigurable RAA 102 can dynamically steer the received modulated data signal 112 in both the azimuth and elevation directions. The switching frequency, however, can be maintained, thereby maintaining the input data signal 114 while the modulated data signal 112 is steered.

Figure 8:
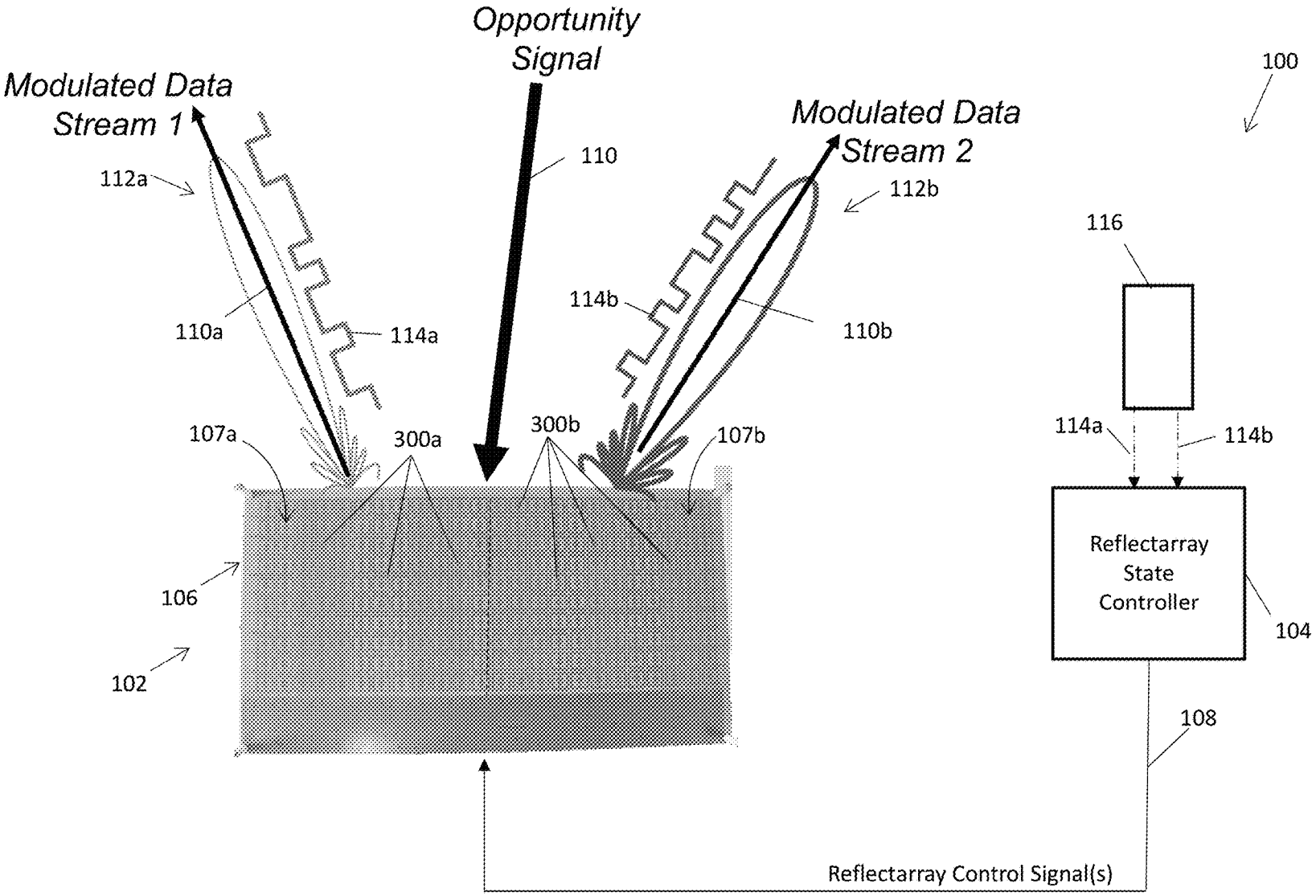
FIG. 8 depicts a reconfigurable RAA system including a partitioned metamaterial surface to split a signal of opportunity into two separate modulated data signals that are beam steered in different directions according to a non-limiting embodiment.

In one or more non-limiting embodiments, the reconfigurable RAA system 100 can utilize a signal of opportunity to generate multiple modulated data signals that are beam steered in different directions with respect to one another. With reference to FIG. 8, for example, a reconfigurable RAA system 100 is illustrated including a reconfigurable RAA 102 having a partitioned metasurface 106 configured to receive one or more signals of opportunity 110. The partitioned metasurface 106 includes unit cells 300*a*, 300*b*, which are partitioned into two groups 107*a* and 107*b* configured to split the signal of opportunity 110 into two separate reflected signals 110*a* and 110*b*. It should be appreciated that the metasurface 106 can include more than two partitioned groups 107*a* and 107*b*. For example, the metasurface 106 can include three partitioned groups, four partitioned groups, seven partitioned groups, etc., without departing from the scope of the invention. Accordingly, each partitioned group can split an impinging signal of opportunity to generate a reflected signal from a corresponding partitioned group.

In the example shown in FIG. 8, the controller 104 receives first and second data signals 114*a* and 114*b*. In some embodiments, the first and second data signals 114*a* and 114*b* can include the same data, while in other embodiments the first and second data signals 114*a* and 114*b* can include different data with respect to one another. In either case, the controller 104 generates control signals to each group 107*a*, 107*b* of unit cells 300*a*, 300*b*, which can effect different beam steering directions and/or modulations to the reflected modulation data signals 112*a* and 112*b*. In one or more embodiments, the controller 104 can dynamically switch the "open" state and "shorted" state of different unit cells 300*a*, 300*b* in the respective groups 107*a* and 107*b* and/or dynamically change the switching frequency of the unit cells 300*a*, 300*b* to dynamically change the modulation and/or direction of the reflected modulated signals 112*a*, 112*b* in real time. In this manner, the incident signal 110 can be split into two separate modulated signals 112*a* and 112*b*, which are beam steered reflected from the metamaterial surface 106 is in two different directions. Accordingly, a first receiver (not shown in FIG. 8) positioned at a first location can receive the first modulated signal 112*a* while a second receiver (not shown in FIG. 8) positioned at a different second location can receive the second modulated signal 112*b*.

Figure 9:
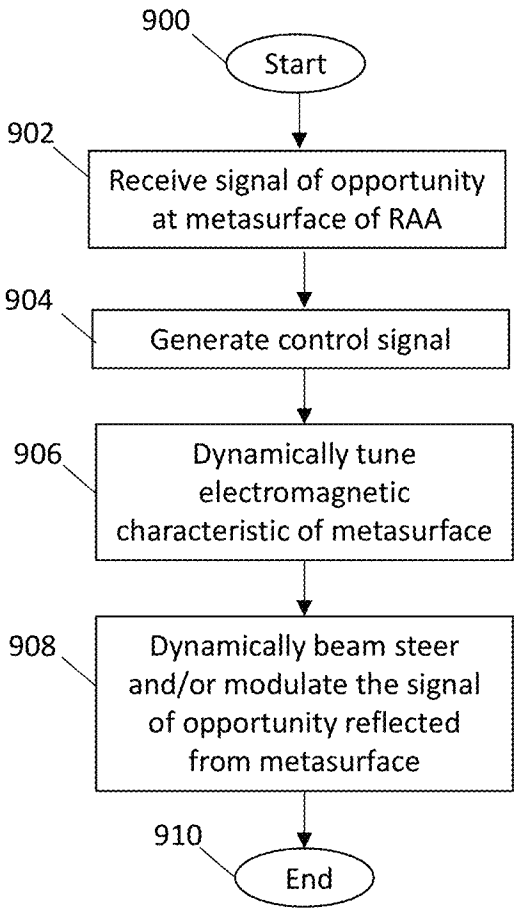
FIG. 9 is a flow diagram illustrating a method of communicating a signal using a reconfigurable RAA system according to a non-limiting embodiment.

Turning now to FIG. 9, a method of communicating a signal using a reconfigurable RAA system is illustrated according to a non-limiting embodiment. The method begins at operation 900, and at operation 902 a signal of opportunity 110 is received at a metasurface 106 of a reconfigurable RAA system 100. At operation 904, a controller 104 in signal communication with the reconfigurable RAA 102 generates a control signal 108. At operation 906, one or more electromagnetic characteristics of the metasurface 106 are dynamically tuned based on the control signal 108. At operation 908, the signal of opportunity is reflected from the metasurface 106 and is modulated and/or dynamically beam steered in a targeted direction, and the method ends at operation 910.

As described herein, various non-limiting embodiments provide a reconfigurable RAA system that includes an RAA capable of communicating an energy signal that is generated separately and independently from the RAA system and already present in the vicinity of the reconfigurable RAA rather than being actively generated by a local transmitter connected to the RAA. In one or more embodiments, the RAA system includes a RAA having reconfigurable metasurface capable of operating at extremely low power to generate a modulated data signal and beam steering the modulate data signal to a targeted receiver.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The Figures illustrate the architecture, functionality, and operation of possible implementations of systems, methods, and computer program products according to various embodiments. In this regard, each block in the Figures may represent one or more components, units, modules, segments, or portions of instructions, which comprise one or more executable instructions for implementing the specified logical function(s). The functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the Figures, and combinations of blocks in the Figures, can be implemented by special purpose hardware-based systems that perform the specified functions or acts or carry out combinations of special purpose hardware and computer instructions.

The descriptions of the various embodiments herein have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A reconfigurable reflectarray antenna (RAA) system comprising:

a reconfigurable RAA including a metasurface having at least one dynamically tunable electromagnetic characteristic and configured to receive at least one signal of opportunity generated separately and independently from the reconfigurable RAA system;

a signal detection system configured to detect the signal of opportunity received by the reconfigurable RAA, and generate signal information corresponding to the received signal of opportunity; and a controller in signal communication with the reconfigurable RAA, the controller configured to generate a control signal configured to dynamically tune the at least one electromagnetic characteristic of the metasurface, the at least one electromagnetic characteristic including a reflection phase configured to dynamically beam steer the at least one signal of opportunity reflected from the metasurface, wherein the controller outputs the control signal to perform one or both of beam steering the at least one signal of opportunity and modulation of the at least one signal of opportunity based on the signal information.

2. The reconfigurable RAA system of claim 1, wherein the metasurface includes a plurality of individual unit cells, each unit cell including a resonant structure in signal communication with a tunable component.

3. The reconfigurable RAA system of claim 2, wherein the tunable component is selected from a group comprising a PIN diode, a varactor, a microelectromechanical (MEM) device, and a liquid crystal polymer device.

4. The reconfigurable RAA system of claim 2, wherein the tunable component is a gallium arsenide (GaAs) FET.

5. The reconfigurable RAA system of claim 1, wherein the controller is further configured to dynamically vary the reflective phase of the metasurface so as to dynamically beam steer the at least one signal of opportunity reflected from the metasurface.

6. The reconfigurable RAA system of claim 5, wherein the controller receives an input data signal and outputs the control signal to vary the reflective phase of the metasurface based on the input data signal to generate a modulated data signal.

7. The reconfigurable RAA system of claim 1, wherein the signal detection system is configured to detect a plurality of signals of opportunity impinging the metasurface and to generate the signal information corresponding to each of the signals of opportunity, wherein the controller, based on the signal information, identifies a targeted signal of opportunity to perform one or both of the beam steering and the modulation, while disregarding one or more non-targeted signals of opportunity.

8. The reconfigurable RAA system of claim 7, wherein the signal information includes information selected from a group comprising angle of arrival, frequency, and power.

9. The reconfigurable RAA system of claim 7, wherein the reconfigurable RAA splits the targeted signal of opportunity into a first signal and second signal, modulates the first signal to generate a first modulated data signal that is steered in a first direction from the metasurface, and modulates the second signal to generate a second modulated data signal that is steered in a second direction from the metasurface different from the first direction.

10. A method of communicating a signal, the method comprising:

receiving, via a metasurface included in a reconfigurable RAA, at least one signal of opportunity generated separately and independently from the reconfigurable RAA;

detecting, via a signal detection system, the received signal of opportunity;

generating, via the signal detection system, signal information corresponding to the received signal of opportunity;

generating, via a controller in signal communication with the reconfigurable RAA, a control signal configured to dynamically tune at least one electromagnetic characteristic of the metasurface;

outputting, via the controller, the control signal to perform one or both of beam steering the at least one signal of opportunity and modulation of the at least one signal of opportunity based on the signal information; and dynamically beam steering the at least one signal of opportunity reflected from the metasurface in response to dynamically tuning the at least one electromagnetic characteristic.

11. The method of claim 10, wherein the metasurface includes a plurality of individual unit cells, each unit cell including a resonant structure in signal communication with a tunable component.

12. The method of claim 11, wherein the tunable component is selected from a group comprising a PIN diode, a varactor, a microelectromechanical (MEM) device, and a liquid crystal polymer device.

13. The method of claim 11, wherein the tunable component is a gallium arsenide (GaAs) FET.

14. The method of claim 10, further comprising dynamically varying, via the controller, a reflective phase of the metasurface so as to dynamically beam steer the at least one signal of opportunity reflected from the metasurface.

15. The method of claim 14, further comprising:

receiving, via the controller, an input data signal; and outputting, via the controller, the control signal to vary the reflective phase of the metasurface based on the input data signal to generate a modulated data signal.

16. The method of claim 10, further comprising:

detecting, via the signal detection system, a plurality of signals of opportunity impinging the metasurface;

generating, via the signal detection system, the signal information corresponding to each of the signals of opportunity; and identifying, via the controller, a targeted signal of opportunity to perform one or both of the beam steering and the modulation based on the signal information, while disregarding one or more non-targeted signals of opportunity.

17. The method of claim 16, wherein the signal information includes information selected from a group comprising angle of arrival, frequency, and power.

18. The method of claim 16, further comprising:

splitting, via the reconfigurable RAA, the targeted signal of opportunity into a first signal and second signal;

modulating the first signal to generate a first modulated data signal;

steering the first modulated data signal in a first direction from the metasurface;

modulating the second signal to generate a second modulated data signal; and steering the second modulated data signal in a second direction from the metasurface different from the first direction.

* * * * *